US005372271A

United States Patent [19]

Miller et al.

[11] Patent Number: 5,372,271

[45] Date of Patent: Dec. 13, 1994

[54] PEDAL ACTUATED WASTE DISPOSAL BIN

[76] Inventors: Michael G. Miller, 5 Island Ave., #4F, Miami Beach, Fla. 33176; Tommy G. Tucker, 19800 SW. 180 Ave., #312, Miami, Fla. 33178; Dean A. Chafin, 23001 SW. 182 Ave., Miami, Fla. 33170

[21] Appl. No.: 228,100

[22] Filed: Apr. 15, 1994

[51] Int. Cl.[5] ..... B65D 43/26

[52] U.S. Cl. ..... 220/263; 220/908

[58] Field of Search ..... 220/262, 263, 264, 908, 220/909; 232/43.1, 43.2

[56] References Cited

U.S. PATENT DOCUMENTS

| | | | |
|---|---|---|---|
| 1,763,756 | 6/1930 | Casapollo | 220/263 |
| 5,048,712 | 9/1991 | Wolters | 220/262 |
| 5,147,056 | 9/1992 | Ma | 220/263 |
| 5,163,574 | 11/1992 | Sosan | 220/264 |

*Primary Examiner*—Allan N. Shoap
*Assistant Examiner*—Nova Stucker
*Attorney, Agent, or Firm*—Robert M. Downey

[57] ABSTRACT

A waste disposal bin for containing a trash can therein includes a four wall cabinet with a flap panel hingedly attached in blocking relation to an opening through an upper portion of a front wall. A pedal, exteriorly accessible at a base of the front wall, interconnects with a linkage assembly structured to cause the flap panel to be swung open and closed relative to the opening through the upper portion of the front wall upon corresponding downward and upward movement of the pedal respectively. The linkage assembly includes a combined rigid linkage assembly and a flexible linkage assembly structured and disposed to move the flap panel through a greater range of movement relative to a range of movement of the foot pedal, both the flexible and rigid linkage assemblies being at least partially concealed and segregated from a remainder of the cabinet interior so as to avoid interference with removal and replacement of the trash can and contact with trash being deposited through the opening of the front wall.

7 Claims, 2 Drawing Sheets

PEDAL ACTUATED WASTE DISPOSAL BIN

BACKGROUND OF THE INVENTION

1. Field of the Invention

The present invention relates to garbage disposal apparatus, and specifically to trash bins of the type including a foot actuated swinging door or flap panel on an upper portion of one of the walls of the bin for allowing food or trash to be dumped into a trash can contained therein.

2. Description of the Related Art

Trash bins of the type commonly found in most fast food restaurants generally comprise a four sided cabinet with a top for holding empty trays and a swinging door or flap panel on one of the sides wherein by pushing the flap panel open with the edge of the food tray, or with one's hand, garbage may be dumped into a trash can within the cabinet. When the tray, having trash on it, is used to push the flap panel open, the flap panel inevitably forces the trash (often including liquids and unconsumed food products) off of the tray, and in many instances, onto the front of the flap panel, the cabinet and the floor. Alternatively, the flap panel may be pushed open using one's hand. While this method usually prevents interference of the flap panel with the trash on the tray, the weight of the trash on the tray may make it difficult for some individuals, such as children or the elderly, to maneuver the tray through the opening of the cabinet using only one hand while holding the flap open with the other hand. A further problem is presented if the face of the flap is soiled by food spillage from previous disposals as is often the case when trays have been used to push the flap open, resulting in the flap brushing against the trash as it is being dumped. For this reason, it is generally inconvenient and an unpleasant experience to use one's hand to force open the flap in order to dump trash into the trash can.

In an attempt to overcome the problems associated with conventionally known trash bins, as described above, there have been various assemblies developed which are designed to move the flap panel open without having to physically push the flap with one's hand or tray. Some of these types of assemblies are disclosed in the U.S. Patents to Sosan, U.S. Pat. No. 5,163,574; Ma, U.S. Pat. No. 5,147,056; and Sing, U.S. Pat. No. 4,765,548, all of which include a foot actuated pedal which interconnects with the flap panel for operative movement thereof. Additionally, U.S. Pat. No. 4,907,715 to Bloomer discloses a hand operated lever mechanism for moving the flap panel between the open and closed positions. While the Bloomer door or flap opener avoids the need to touch a soiled flap panel, one hand is still needed to operate the opening of the flap panel.

The foot actuated pedal assemblies, as described above, interconnect to the flap panel by either a rigid linkage system or a cable. Specifically, the patents to Ma and Sosan disclose a cable linkage while Sing is directed to a rigid linkage system.

The primary problem with a direct cable linkage is the fact that the amount of movement of the cable is directly and equally proportional to the amount of movement of the flap. Therefore, the pedal must be depressed a considerable distance in order to move the flap to the fully open position, as is required to prevent contact of the flap with the waste material on the tray. On the other hand, pedal actuated trash bins that use an entirely rigid linkage system do not allow for manual movement of the flap as may be required by handicapped persons or instances where the linkage system jams or otherwise fails.

Other important considerations which need to be addressed include the ability to access the trash bin or cabinet interior to remove and replace the trash can, as well as the need to avoid contact of the waste material (especially food products) with the linkage system when dumping trash through the flap opening. The systems disclosed in the above-identified U.S. Patents all have inherent weaknesses which fail to overcome these considerations. Specifically, the Sosan trash bin does not permit opening of the top lid (for removing the trash can) if the cabinet is positioned with its back to a wall surface, as is usually the case in most fast food restaurants. The trash bin assemblies of Ma and Sing incorporate much of the linkage system on the front door which needs to be opened (the preferable design to permit side by side placement of trash bins against a wall) in order to access the trash can therein. The linkage systems of these assemblies will interfere with a removal and replacement of the trash can, whether through the front door or through side doors.

Accordingly, there still exists a need in the present art for a trash cabinet having a flap panel opened by a foot actuated mechanism which is protected from exposure to waste dumped through the flap opening and which is further structured and disposed to facilitate uninterrupted access through a front door of the cabinet to remove and replace the trash can contained therein. There is a further need in the present art for a trash cabinet having a flap panel opened by a foot actuated mechanism, but which can be opened independently from the foot actuated mechanism, wherein a small range of movement of a pedal thereof results in a greater range of movement of the flap panel.

SUMMARY OF THE INVENTION

The present invention is specifically designed to overcome the problems set forth above and includes a pedal attached to a linkage system including a horizontal linkage member pivotally mounted in a base of the cabinet and having the pedal attached to one end thereof. An opposite end of the horizontal linkage member connects to a vertical linkage member which extends upwardly between an interior vertical wall panel, defining a false back, and a rear wall of the cabinet. Upon stepping on the pedal, the horizontal linkage is caused to pivot, forcing the vertical linkage upwardly. The vertical linkage connects to a first end of a lever which is mounted on an off-center pivot to the rear wall of the cabinet, behind the false back panel. Upward movement of the first end of the lever results in an opposite second end moving downwardly a greater distance than the first end due to the off-center pivot. A flexible cable connects between the second end of the lever, and an inner side of the flap panel, near a bottom edge thereof. Upon downward movement of the second end of the lever, the cable is caused to pull the flap panel inwardly and upwardly to a fully opened position, facilitating dumping of waste products into a trash can contained within the cabinet without interfering with the linkage system. Due to off-center pivots of both the horizontal linkage member and the lever, the range of movement is magnified between the pedal and the second end of the lever, resulting in the cable pulling the flap through a greater range of movement relative to a range of movement of the pedal. Thus, downward movement of the pedal a short distance results in the flap panel being swung to the fully open position.

With the foregoing in mind, it is a primary object of the present invention to provide a trash cabinet for containing a trash can therein and including a foot actuated flap panel interconnected to a foot pedal by a linkage system which is specifically structured and disposed to avoid interference with removal and replacement of the trash can from within the cabinet.

It is another object of the present invention to provide a trash cabinet having a foot actuated flap panel having a linkage system specifically structured and disposed to avoid interference with dumping of food and trash through a flap opening of the cabinet into a trash can contained therein.

It is still a further object of the present invention to provide a trash cabinet including a foot actuated flap panel interconnected to a foot pedal by a linkage system, the linkage system being specifically structured to cause the flap panel to be moved through a greater range of movement relative to a range of movement of the foot pedal.

It is yet a further object of the present invention to provide a trash cabinet, including a foot actuated flap panel interconnected to a foot pedal by a combined rigid and flexible linkage system, enabling the flap panel to be swung open by either depressing the foot pedal or manually pushing the flap panel open.

These and other objects of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
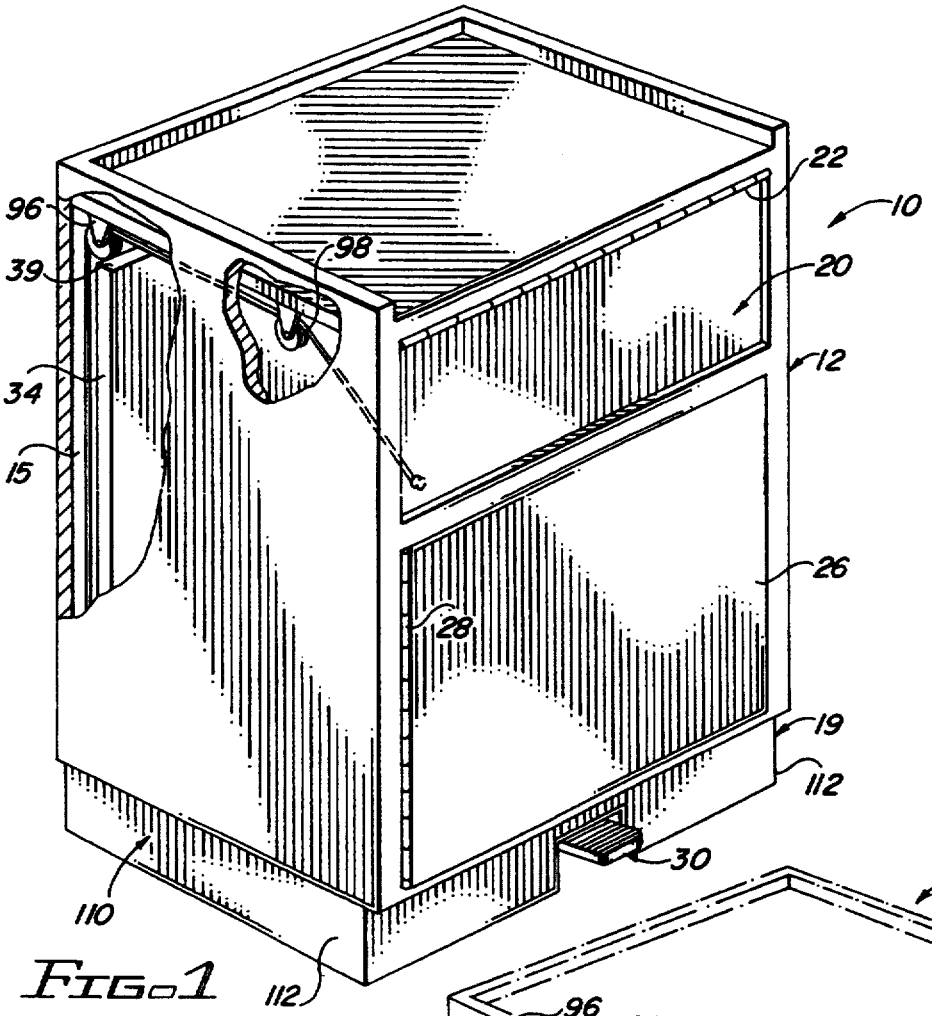
FIG. 1 is a perspective view, in partial cut-away, illustrating the trash cabinet of the present invention.

Referring to FIGS. 1–4, there is generally illustrated the waste disposal apparatus 10 of the present invention. As illustrated in FIG. 1, the waste disposal apparatus 10 comprises a cabinet 12 including a front wall 14, a rear wall 15, opposite side walls 16, 17, a top 18 and a base portion 19.

A flap panel 20 is hingedly attached along a top edge by hinge 22 such that the flap panel is normally disposed in blocking relation to an opening 24 (see FIG. 3) through the front wall through an upper portion of the front wall 14.

Figure 4:
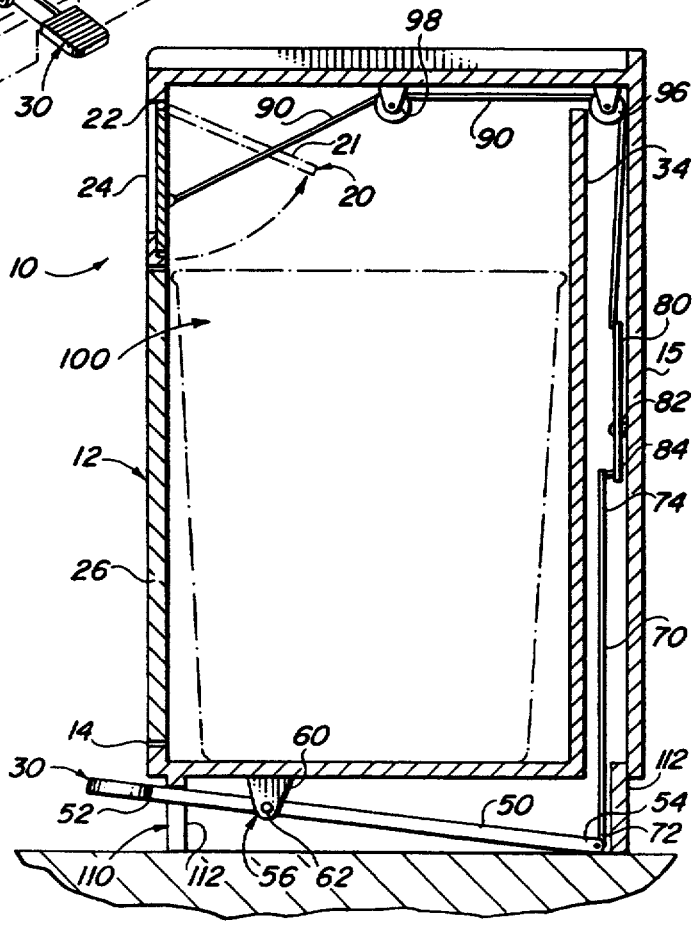
FIG. 4 is a side elevation, in partial section, illustrating an interior assembly of the trash cabinet and linkage system.

A front door 26 is further provided on the front wall 14, hingedly attached thereto along a side edge by hinge 28 such that the door is able to swing open, facilitating placement and removal of a trash can 100 therein (see FIG. 4). The opposite side walls 16, 17 and rear wall 15 may extend upwardly beyond the top 18 of the cabinet 12, providing a barrier so that empty food trays may be stacked upon the top 18.

A foot pedal 30 is exteriorly accessible at the base portion 19 of the cabinet 12 below the front door 26 and is movable between a first up position and second down position.

An interior vertical wall panel 34 extends upwardly from the base portion 19 in parallel relation to the rear wall 15 within an interior 26 of the cabinet. The interior vertical wall panel 34 connects to inner surfaces of the opposite side walls 16, 17 along opposite edges and includes an upper edge 39 disposed in spaced relation below the top 18 of the cabinet.

Figure 2:
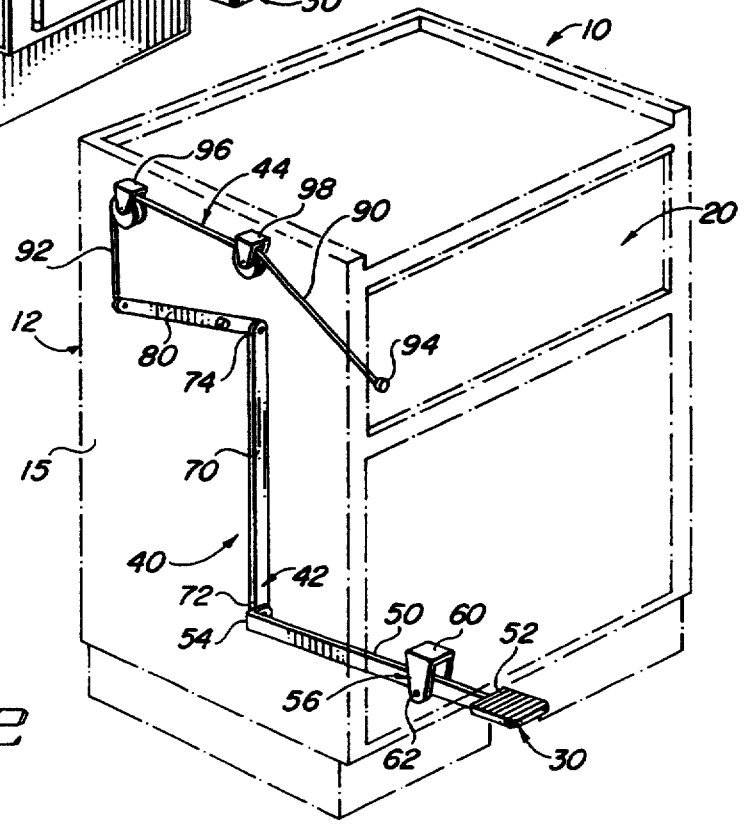
FIG. 2 is a broken line illustration of the trash cabinet showing the foot pedal and linkage system of the present invention.

Referring to FIG. 2, there is illustrated a linkage system 40 of the present invention. The linkage system 40 interconnects between the foot pedal 30 and the flap panel 20 and is specifically structured to move the flap panel between a closed position and an opened position, relative to the opening 24, upon respective movement of the foot pedal 30 between the up position and the down position. The linkage system 40 includes a rigid linkage assembly 42 and a flexible linkage assembly 44.

The rigid linkage assembly 42 includes a first generally horizontal rigid linkage member 50 having the pedal 30 attached to a distal end 52 thereof and an opposite proximal end 54 disposed at a rear lower portion of the cabinet interior. The linkage member 50 is pivotally mounted on a horizontal axis at 56. The pivot may include a bracket 60 supporting a horizontal axle 62 serving as a fulcrum to permit the linkage member 50 to pivot. Preferably, the horizontal axle 62 (pivot point) is positioned closer to the distal end 52 of the linkage member 50 such that upon movement of the pedal 30, the proximal end 54 of the linkage member 50 is caused to move a greater distance in an opposite direction.

The rigid linkage system further includes a rigid, vertical linkage member 70 extending vertically between the interior vertical wall panel 34 and the rear wall 15 of the cabinet 12 and including a lower end 72 attached to the proximal end 54 of the linkage member 50. An opposite upper end 74 of vertical linkage member 70 attaches to a lever 80 pivotally mounted to an inner side of the rear wall 15, between the rear wall 15 and the interior vertical wall 34, on a pivot 82, the pivot 82 being off-center and closer to a first end 84 of the lever such that upon movement of the first end 84, an opposite end 86 of the lever 80 is caused to be moved a greater distance in the opposite direction.

Accordingly, operation of the rigid linkage system 40 is accomplished by depressing the foot pedal 30 downwardly resulting in upward movement of the proximal end 54 of linkage member 50 and the attached vertical linkage member 70 forcing first end 84 of lever 80 upwardly and resulting in the opposite second end 86 of the lever 80 moving downwardly a greater distance.

Figure 3:
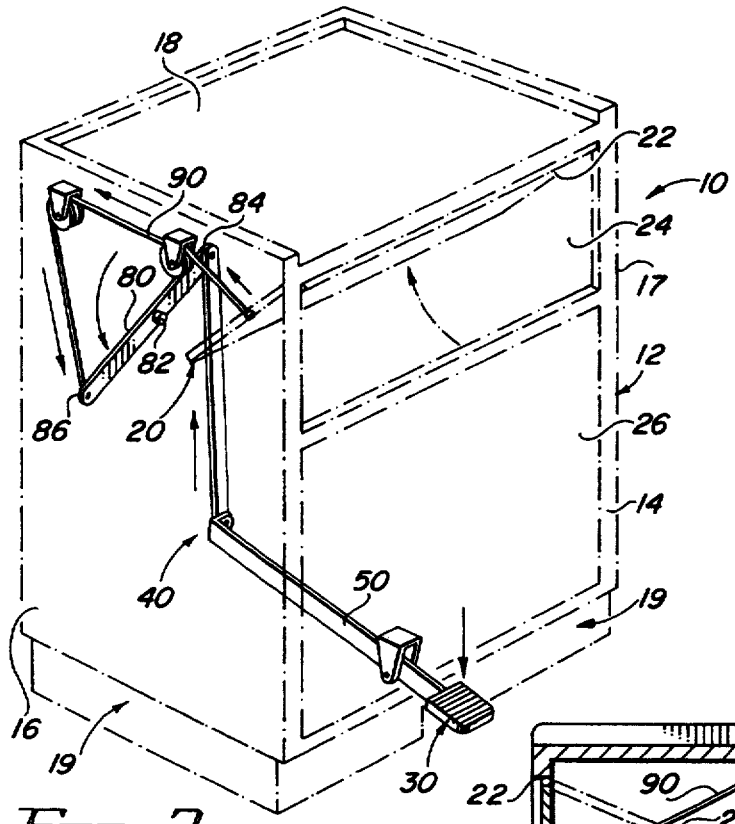
FIG. 3 is a broken line drawing of the trash cabinet, illustrating operation of the linkage system to cause a flap panel of the trash cabinet to be opened.

The flexible linkage assembly 44 includes a cable 90 attached at one end 92 to the second end of lever 70 and at an opposite end 94 to an inner side 21 of the flap panel 20 near a bottom edge thereof. The cable 90 is guided vertically upward and over the upper edge 39 of the interior vertical wall panel 34 by a first guide pulley 96. A second guide pulley 98 directs the cable downwardly towards a lower portion of the flap panel 20 near the bottom edge such that upon downward movement of the second end of the lever 70, the cable 90 is caused to pull the flap panel inwardly and upwardly, as seen in FIGS. 3 and 4. The cabinet 12 may further be provided with a floor 99 attaching to the front 14, rear 15, and side walls 16, 17 above the base portion 19. As seen in FIG. 4, the trash can 100 may be supported on the floor 99 such that an open top of the trash can 100 is disposed below a level of the opening through the upper portion of the front wall 14. In this manner, food and other waste material may be deposited through the opening, once having opened the flap panel for dumping into the trash can 100 contained with the cabinet.

As best seen in FIG. 4, the rigid linkage assembly is protectively isolated from a remainder of the cabinet interior by the floor 99 and interior vertical wall panel 34. Further, the cable 90 and guide pulleys 96, 98 are specifically positioned and disposed so as to avoid interference with waste material being deposited through the opening for dumping into the trash can 100. Further, the linkage system, including the rigid linkage assembly 42 and the flexible linkage assembly 44 is specifically structured and disposed to avoid interference with removal and replacement of the trash can through the front door of the cabinet 12.

The base portion 19 may be an extension of the front, side and rear walls. Alternatively, a base assembly 110 may be provided and including vertical base walls 112 preferably formed of metal or other non-corrosive material. The base assembly defines a kick plate and is specifically structured to prevent damage to the cabinet as may result from exposure to water on the floor surface.

Now that the invention has been described,

What is claimed is:

1. A waste disposal apparatus for containing a trash can therein comprising:

a cabinet including a front wall, a rear wall, opposite side walls, a top and a base portion disposed in surrounding relation to a cabinet interior, a flap panel hingedly attached on said front wall and movable between a closed position and an open position and normally disposed in blocking relation to an opening through an upper portion of said front wall defining said closed position, access means on said cabinet for permitting removal and replacement of the trash can within said cabinet interior, a foot pedal exteriorly accessible at said base portion of said cabinet and movable between a first up position and a second down position, an interior vertical wall panel extending upwardly from said base portion in parallel relation to said rear wall within said cabinet interior and terminating at an upper edge in spaced relation to said top of said cabinet, linkage means interconnecting between said foot pedal and said flap panel for moving said flap panel between said open and closed positions upon movement of said foot pedal, said linkage means including a rigid linkage assembly and a flexible linkage assembly, said rigid linkage assembly including:

a first rigid member in said base portion of said cabinet and including a distal end attached to said foot pedal, an opposite proximal end, and a mid-length extending therebetween said first rigid member being pivotally mounted to said cabinet at a fulcrum point along said mid-length, a lever including a first end and an opposite second end, said lever being movably mounted to said cabinet between said rear wall and said interior wall and removable about a pivot point located closer to said first end such that upon movement of said lever about said pivot point, said opposite second end is caused to be moved a greater distance than said first end, and a second rigid member disposed between said rear wall and said interior wall and connecting between said proximal end of said first rigid member and said first end of said lever, such that movement of said foot pedal between said up and down positions results in movement of said second end of said lever through a greater range of distance than a range of movement of said foot pedal, and said flexible linkage assembly including:

a cable having one end attached to said second end of said lever and an opposite end attached to said flap panel and causing to said flap panel to be pulled to said open position upon downward movement of said second end of said lever, and guide means for guiding said cable over said upper edge of said interior wall and between said lever and said flap panel.

2. A waste disposal apparatus for containing a trash can therein comprising:

a cabinet including a front wall, a rear wall, opposite side walls, a top and a base portion disposed in surrounding relation to a cabinet interior, a flap panel hingedly attached on said front wall portion and movable between a closed position and an open position and normally disposed in blocking relation to an opening through an upper portion of said front wall defining said closed position, access means on said cabinet for permitting removal and replacement of the trash can within said cabinet interior, a foot pedal exteriorly accessible at said base portion of said cabinet and movable between a first up position and a second down position, an interior vertical wall panel extending upwardly from said base portion in parallel relation to said rear wall within said cabinet interior, linkage means interconnecting between said foot pedal and said flap panel for moving said flap panel between said open and closed positions upon movement of said foot pedal, said linkage means including a rigid linkage assembly and a flexible linkage assembly, and said linkage means including leverage means for moving said flap panel through a proportionately greater range of movement relative to a range of movement of said foot pedal.

3. An apparatus as recited in claim 2 wherein said rigid linkage assembly includes a first rigid linkage member in said base portion of said cabinet and including a distal end attached to said foot pedal, an opposite proximal end, and a mid-length extending therebetween, said first rigid linkage member being pivotally mounted to said cabinet at a fulcrum point along said mid-length.

4. An apparatus as recited in claim 3 wherein said rigid linkage assembly further includes a second rigid linkage member vertically disposed between said rear wall and said interior wall and connecting at a lower end thereof to said proximal end of said first rigid linkage member.

5. An apparatus as recited in claim 4 wherein said leverage means includes a lever having a first end attached to an upper end of said second rigid linkage member and an opposite second end, said lever being pivotally mounted to said cabinet interior between said rear wall and said interior wall and being movable about a pivot point located closer to said first end such that upon movement of said lever about the pivot point, said opposite second end of said lever is caused to be moved a greater distance than said first end of said lever.

6. An apparatus as recited in claim 5 wherein said flexible linkage assembly includes a cable connecting between said second end of said lever and an inner side of said flap panel near a bottom edge thereof.

7. An apparatus as recited in claim 6 wherein said flexible linkage assembly further includes a plurality of guide pulleys specifically structured and disposed to guide said cable between said lever and said flap panel.

* * * * *